US008127824B2

(12) United States Patent
Terada et al.

(10) Patent No.: US 8,127,824 B2
(45) Date of Patent: Mar. 6, 2012

(54) AUTOMATIC POURING METHOD AND DEVICE

(75) Inventors: Hideto Terada, Nagoya (JP); Chiaki Kato, Nagoya (JP)

(73) Assignees: Sintokogio, Ltd., Aichi (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 12/923,890

(22) Filed: Oct. 13, 2010

(65) Prior Publication Data

US 2011/0031285 A1 Feb. 10, 2011

Related U.S. Application Data

(62) Division of application No. 11/948,396, filed on Nov. 30, 2007.

(30) Foreign Application Priority Data

Feb. 15, 2007 (JP) ..... 2007-034175
Mar. 2, 2007 (JP) ..... 2007-052316

(51) Int. Cl.
*B22D 39/00* (2006.01)
*B22D 41/06* (2006.01)

(52) U.S. Cl. ..... 164/335; 164/336; 164/337; 164/135; 164/136

(58) Field of Classification Search ..... 164/135, 164/136, 155.1, 155.2, 335–337, 457; 222/164–166, 222/604

See application file for complete search history.

(56) References Cited

U.S. PATENT DOCUMENTS 3,311,361 A * 3/1967 Zepernick ..... 266/240
3,531,074 A * 9/1970 Van Dine et al. ..... 248/141
4,112,998 A * 9/1978 Sato ..... 164/136

FOREIGN PATENT DOCUMENTS

JP 05069111 A * 3/1993
JP 05329622 A * 12/1993
JP 6-190541 7/1994
JP 7-112270 5/1995
JP 9-1320 1/1997
JP 2001-507631 6/2001

OTHER PUBLICATIONS

JPO machine translation of JP 05069111 A, Mar. 23, 1993.*
JPO machine translation of JP 05329622 A, Dec. 14, 1993.*

* cited by examiner

*Primary Examiner* — Jessica L Ward
*Assistant Examiner* — Kevin E Yoon
(74) *Attorney, Agent, or Firm* — Finnegan, Henderson, Farabow, Garrett & Dunner, L.L.P.

(57) ABSTRACT

An automatic pouring method without using a servomotor having a vertical output shaft, establishing the pouring at a low level, eliminating the unstable pouring, sand inclusion, and gaseous defects. An automatic pouring method using a ladle to be tilted for pouring molten metal into a pouring cup of a flaskless or tight-flask mold in at least one pouring device movable along an X-axis parallel to a molding line in which the mold is transferred, wherein the ladle is moved along a Y-axis perpendicular to the molding line in a horizontal plane and is tilted about a first axis of rotation and further about a second axis of rotation.

7 Claims, 14 Drawing Sheets

AUTOMATIC POURING METHOD AND DEVICE

RELATED APPLICATIONS

This is a divisional of application Ser. No. 11/948,396, filed Nov. 30, 2007, which claims priority of Japanese application No. 2007-034175, filed Feb. 15, 2007 and Japanese application No. 2007-052316, filed Mar. 2, 2007, the contents of all of which are incorporated herein by reference.

TECHNICAL FIELD

The present invention relates to an automatic pouring method and an automatic pouring device. Specifically, it relates to an automatic pouring method that can make a pouring device simple and compact, and an automatic pouring device that can carries out that pouring method.

BACKGROUND ART

Prior-Art Patents

Prior-art Patent 1: JP 06-190541 A (Switzerland Patent Application No. 03135/92-4)
Prior-art Patent 2: WO99/00205 (JP 2001-507631 A)
Prior-art Patent 3: JP 07-112270 A
Prior-art Patent 4: JP 09-1320 A Prior-art Patent 1 discloses controlling the tilt of a ladle by the two rotating means connected to the ladle to pour molten metal from the ladle to a mold, as shown in FIG. 2 of it. The first rotating means is an actuator for vertically moving a tilting shaft disposed near the pouring point of the ladle. By that vertical movement, the ladle is rotated about the center of gravity S of the molten metal (the center acts as a virtual axis of rotation). The second rotating means is a suspending wire connected to the ladle at the point D for rotating the ladle about the point K, which is the axis of rotation of the tilting shaft. Specifically, by moving the tilting shaft downward and upward by the actuator to rotate the ladle about the point S at the point of pouring start and stop, the energy generated in the molten metal movement is minimized, thus minimizing the momentum of the molten metal and hence shortening the pouring cycle. When the pouring is to be stopped (i.e., the ladle shown in FIG. 2 is rotated clockwise), the rotating rate at the point S can be made zero by applying a high rotating rate to the point K and applying a low rotating rate to the point D (see FIG. 3). When the pouring starts, by applying similar rotating rates to them counterclockwise, the rotating rate at the point S can be made zero. Prior-art Patent 1 also discloses moving a structure laterally that supports the first and second rotating means so that the pouring point of the ladle approaches the pouring cup of the mold, as shown in FIG. 4. The first and second rotating means are controlled manually or using a program.

The pouring device of prior-art Patent 1 requires a large-scale device (a tower), and it tends to cause problems due to the pouring that is carried out from a higher level, namely, an unstable pouring with turbulent flows, defects of sand and/or gas inclusion, and the like.

Prior-art Patent 2 discloses a device for pouring molten metal in a mold by tilting a ladle about the axis of rotation A of a tilting shaft and by moving the ladle along an X-axis (the directions in which the ladle moves toward and away from the mold) and a Z-axis (the vertical directions) to always keep a theoretical (virtual) pouring point, which is near the pouring point, in the lowest possible position relative to the mold. The ladle is moved along the X-axis, a Y-axis (the directions along the molding line), and the Z-axis by a longitudinal cart, a lateral cart, and a suspension wire, respectively, and is tilted by a drive motor. Since the pouring device of this prior-art Patent 2 also requires a large tower, it tends to cause problems in that it becomes large, to consume great energy, and to be at a high cost. Further, if a tall tower is used, its center of gravity will be located at a high level, causing another problem in that great vibrations generate due to the movement of the pouring device, making pouring accuracy worse. In addition, the tall tower causes another problem in that it limits the transportation path and hence the transportation means, resulting in a longer time to change the ladle. The tall tower causes a further problem in that it blocks its peripheral sight, making it difficult to see if the site is safe under the dangerous working environment where the molten metal is handled.

Prior-art Patent 3 discloses pouring molten metal from a tiltable ladle into a mold by tiltably supporting the ladle by a tilting shaft at the tilting center (this center is supposed to be substantially positioned at the center of gravity of the ladle) and by rotating the tilting shaft by a drive motor about the tilting center, and by simultaneously moving the tilting shaft so that its axis (the tilting center) moves along the circular locus about the pouring point of the ladle so as to keep the pouring point (or a virtual pouring point near that pouring point) in one constant position relative to the mold (i.e., the horizontal distance l and the vertical distance h of the pouring point from the pouring cup of the mold are kept). The ladle is supported by a supporting element lying under it. Moving the tilting shaft along the circular locus about the pouring point when the tilting shaft is rotated (i.e., the ladle is tilted) by the motor is achieved by moving the supporting element along a Y-axis (the directions in which the ladle moves toward and away from the mold) and a Z-axis (the vertical directions). The movement of the ladle along the Y-axis is achieved by a cart, and the movement of the ladle along the Z-axis is achieved by a lifter. The movement of the ladle along the Y-axis and the Z-axis to be generated when it is tilted, is controlled by a controller according to a control flow. The controller also controls the rotating rate of the tilting shaft (i.e., the tilting rate of the ladle) to control the varying rate of the surface of the molten metal. It is called here "a virtual pouring point center system" to rotate the tilting shaft about the virtual pouring point to keep the virtual pouring point in a constant position relative to the pouring cup of the mold, as in prior-art Patent 3.

Prior-art Patent 4 relates to the improvement of the patent of prior-art Patent 3. In prior-art Patent 3, the molten metal may be poured outside the pouring cup of the mold during the pouring if the rate and quantity of the metal flow vary due to the tilt of the ladle. To improve this issue, in prior-art Patent 4 the tilting shaft is moved along a locus that slightly shifts from the circular locus of the tilting shaft about the virtual pouring point of prior-art Patent 3. The movement of the supporting element for the ladle along the Y-axis is achieved by a cart, and its movement along the Z-axis is achieved by an actuator. The tilt of the ladle about the tilting center is achieved by a sector gear secured to the ladle and a means for rotating the sector gear.

In any one of the prior-art Patents, 1-4, the movement of the ladle in the Z-axis is carried out by an actuator, a chain, or a lifter, or the combination of them. Accordingly, the pouring device still have a problem that they are tall.

DISCLOSURE OF THE INVENTION

The present invention has been conceived to solve the above problems. It aims to provide an automatic pouring method that can make the pouring device simple and compact by improving the conventional pouring devices, without using a tower or any driving device for vertical moving the ladle such as an actuator or the like and provide an automatic pouring device that can carries out the pouring method of the present invention. Further, the present invention also aims to provide an automatic pouring device that gives a high precision pouring and easy checking on the safety, and that enables one to easily change the ladle.

To the above end, the automatic pouring method of the present invention is a method using a ladle to be tilted for pouring molten metal into a pouring cup of at least one flaskless or tight-flask mold in at least one pouring device movable along an X-axis parallel to a molding line in which the at least one mold is transferred, wherein the ladle is movable along a Y-axis perpendicular to the molding line in a horizontal plane, and the pouring is carried out just by moving the ladle along the X-axis and the Y-axis and by tilting the ladle about a first axis of rotation, without vertically moving the ladle.

Also, to the above end, the automatic pouring device of the present invention is one for pouring molten metal from a tiltable ladle into at least one mold in a molding line, comprising: a lower cart movable along an X-axis parallel to the molding line; an upper cart mounted on the lower cart for laterally moving along a Y-axis perpendicular the molding line in a horizontal plane; a fixed frame fixedly mounted on the upper cart; a first tilting means for tilting the ladle about a first axis of rotation on the fixed frame; and an electric control unit provided with a program that just controls the movement of the ladle along the X-axis and the Y-axis and the tilt of the ladle about the first axis of rotation, without vertically moving the ladle.

According to the automatic pouring method of the present invention, since without using any drive device for vertically moving the ladle, it moves relative to the mold along the Y-axis perpendicular to the molding line in a horizontal plane and tilts about the first axis of rotation, and since the pouring is carried out by moving the ladle along the X-axis and the Y-axis and tilting it about the first axis of rotation, the problems such as the unstable pouring, the sand inclusion, and the gaseous defects, are eliminated, and the good pouring is carried out with the ladle being positioned at a low level.

Further, according to the automatic pouring device of the present invention, since the drive device for vertically moving the ladle is not used, advantageously the pouring device will be simple and compact. Further, since the center of gravity of the pouring device can be lowered, the vibrations caused by its movement is reduced, and the pouring accuracy is improved. Additionally, since any elevating device such as a tower is not used, the transportation and the replacement of the ladle is easy, and the working efficiency is improved. In addition, eliminating any elevating device such as a tower gives a good sight in the site and enables anyone to check the safety under the dangerous environment where the molten metal is handled.

Additionally, according to the device of the present invention, the electric control unit controls the servomotors for moving and tilting the ladle during the pouring. Accordingly, the invention will be appropriately carried out for low volume production of a wide variety of products of casts just by modifying the program for the positions of parameters of the poured weights of the molten metal, the pouring cups, etc.

Further, according to one aspect of the present invention, since the ladle can also be tilted about a second axis of rotation that is located closer to the center of gravity of the ladle than is the first axis of rotation, the freedom of the ladle is increased, allowing the pouring device to work for various pouring.

In the present invention, the first axis of rotation may be used for tilting the ladle at least for a period from the starting of the pouring to the time just before the stopping of the pouring. The second axis of rotation may be used at least for tilting back the ladle when the pouring is stopped.

The second axis of rotation may be located near the center of gravity of the ladle so that it is tilted back about the axis near its center of gravity. Since in that case the movement of the molten metal in the ladle is less and the pouring is stopped with the tip of the ladle being moved upward, the stopping of the pouring is quickly carried out, greatly improving the pouring accuracy. If the ladle is tilt back about the first axis of rotation, the molten metal moves by a great distance about that axis, causing the surface of the molten metal to vibrate, thereby delaying the completion of the pouring and worsening the pouring accuracy.

Since in this aspect of the present invention the ladle is tilted about the first axis of rotation and the second axes of rotation, which differs from the first one, and since the tilt by the first axis of rotation is the tilt about a point at the tip of the ladle for pouring and the tilt by the second axis of rotation is the tilt back of the ladle about a point near the center of gravity of the ladle for stopping the pouring, the pouring is quickly stopped, and the pouring accuracy is greatly improved.

In addition, in the present invention the position along the Y-axis perpendicular to the molding line in a horizontal plane, and the tilt angles about the first and second axes of rotation, of the ladle, can be conditionally controlled at least during the pouring, for the flow line of the molten metal that varies depending on the properties of the molten metal and the shape of the ladle.

By using this conditioned control, the present invention can quickly work for the change in the pouring weight, the change in the pouring rate, and the change in the flow line, caused by the variation of the tilt angle or angles. Further, the present invention can quickly work for the change in the position the pouring cup. In addition, in the present invention the control of the tilt and the control of the movement along the X-axis and the Y-axis, of the ladle, can be simultaneously carried out at least for a period from the starting to the stopping of the pouring.

By this control, said virtual pouring point center system, the teaching playback system, which will be explained below, and the synchronous pouring system, which will also be explained below, can be used.

In the present invention the teaching playback system can be used to utilize the technique of the skilled worker.

In the teaching playback system, first the skill worker actually pours molten metal from the ladle into one or a few molds, and the relation between the position along the Y-axis, the tilt angles of the shafts (the axes of rotation), the pouring rate, and the time, for that pouring by the worker is stored as a program in the electric control unit. If the product to be cast is changed, a program for that casting is then similarly stored. The teaching playback system is the system where one of the stored programs is selected or changed for use for a product to be actually cast. By using this teaching playback system, the optimum pouring can be immediately achieved for low volume production of a wide variety of products. By the way, the inventors have experienced many times that the pouring accuracy was low when this teaching playback system was not used, but just the mathematical principle computing system was used, since the shape of the ladle or the shape of the cavity of the mold differs.

In addition, the synchronous pouring system can be used in the present invention to establish the pouring by a single pouring device for the molding line that travels at a high speed.

The synchronous pouring system is a method of continuing the pouring even when the mold is traveling at the starting of the pouring or during the pouring. This is achieved, for example, by attaching a sensor to a device that transfer the mold for detecting the transfer rate of the mold, by using a servomotor or an inverter-controlled motor as a drive unit for the lower cart of the pouring device, and by driving the drive unit so that the lower cart is traveled at the same rate as the detected traveling rate of the mold (the traveling rate of the flask when the mold is tight-flask).

In the present invention, scaling the poured molten metal is achieved by always measuring the total weight of the lower cart or the ladle, by inputting the signal on the measured weight to the electric control unit, and by calculating the weight of the molten metal remaining in the ladle and the weight of the poured molten metal. When the weight of the poured molten metal reaches the predetermined weight, the pouring is ended (the weight-feedback system).

BRIEF DESCRIPTION OF THE DRAWINGS

FIG. 6(*b*) is a view showing the step of preparation for pouring.

FIG. 6(*c*) is a view showing the step of starting pouring.

FIG. 6(*d*) is a view showing the step of stopping pouring.

FIG. 6(*e*) is a view showing the step of restarting pouring after the pouring is once stopped.

FIG. 6(*f*) is a view showing the step of tapping all molten metal from the ladle.

BEST MODE FOR CARRYING OUT THE INVENTION

Figure 1:
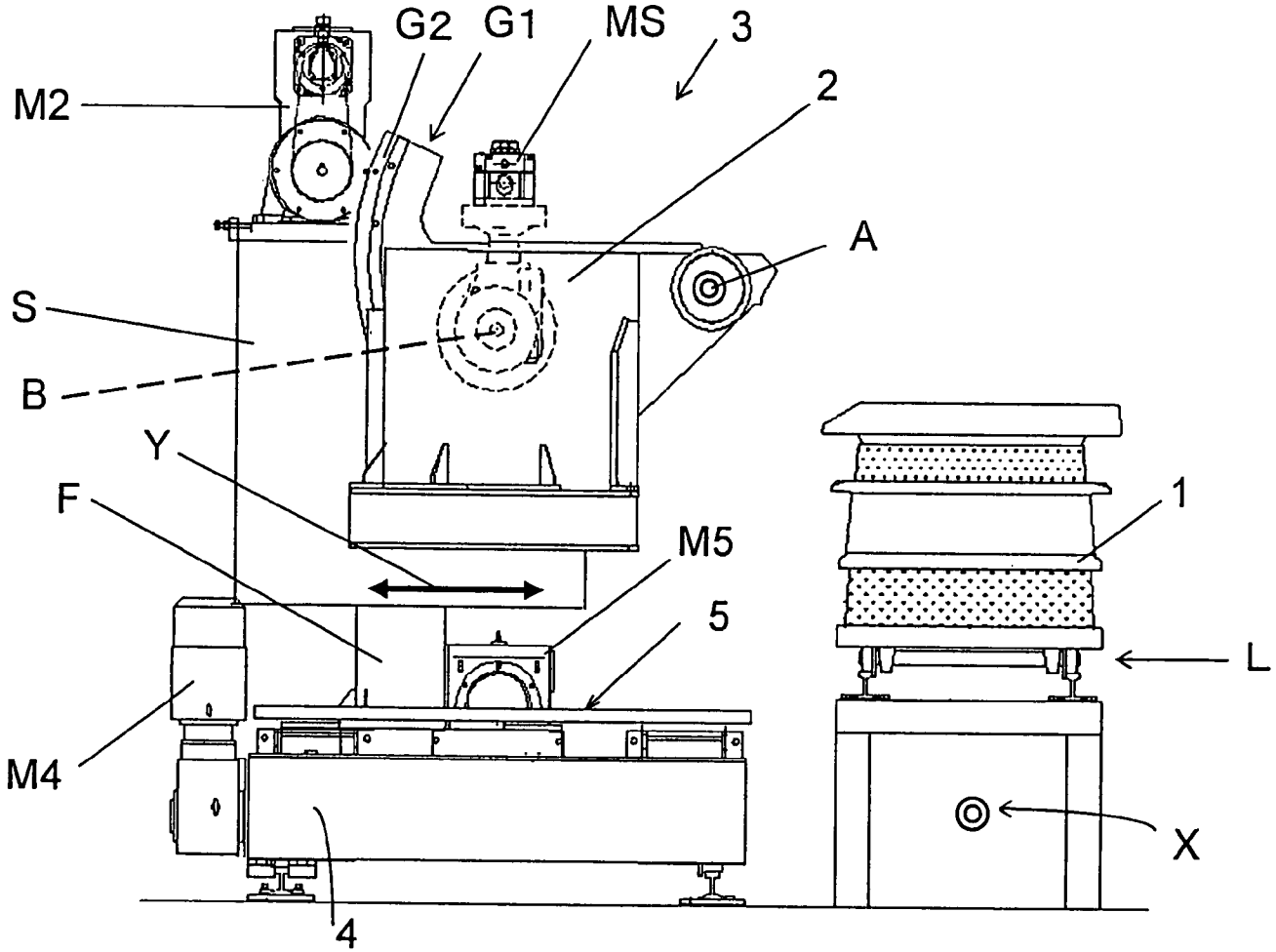
FIG. 1 is a schematic front view of the first embodiment of the automatic pouring device of the present invention.
Figure 2:
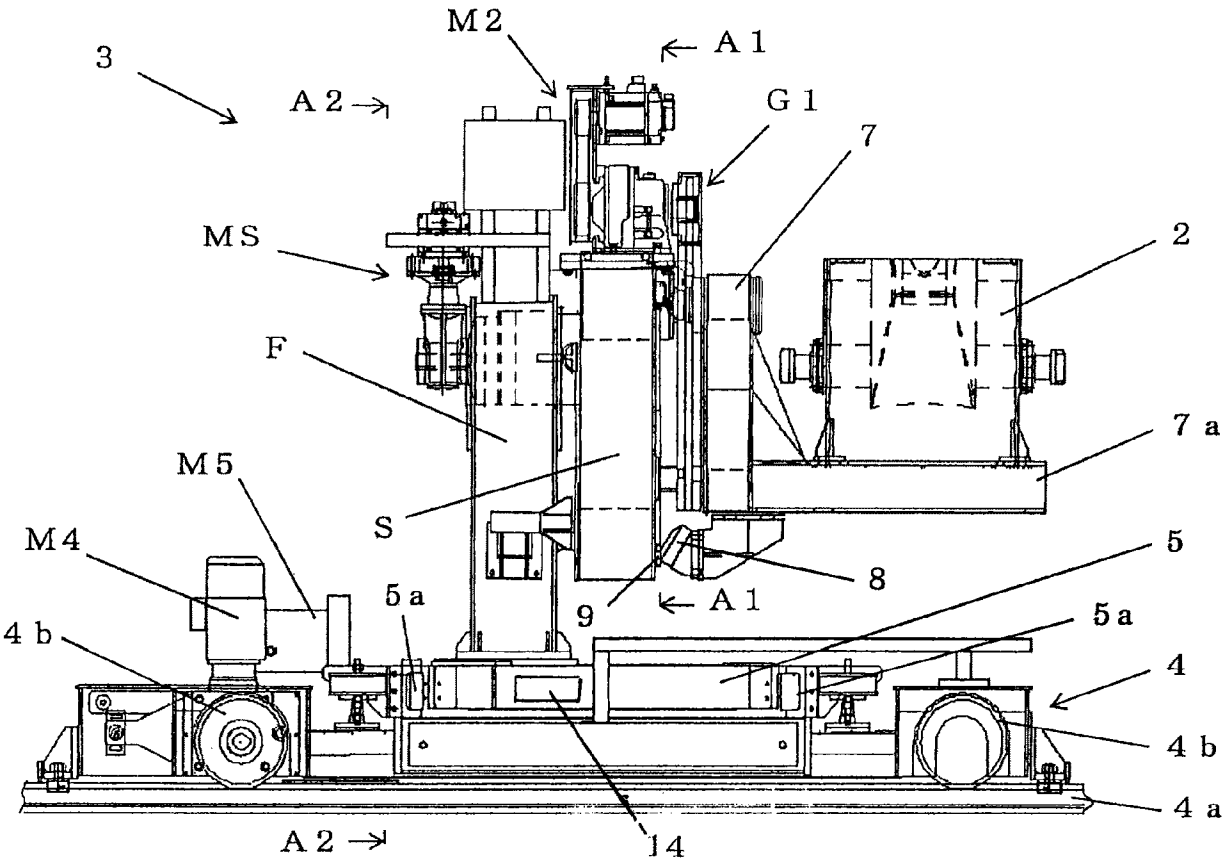
FIG. 2 is a side view of the automatic pouring device of FIG. 1.
Figure 3:
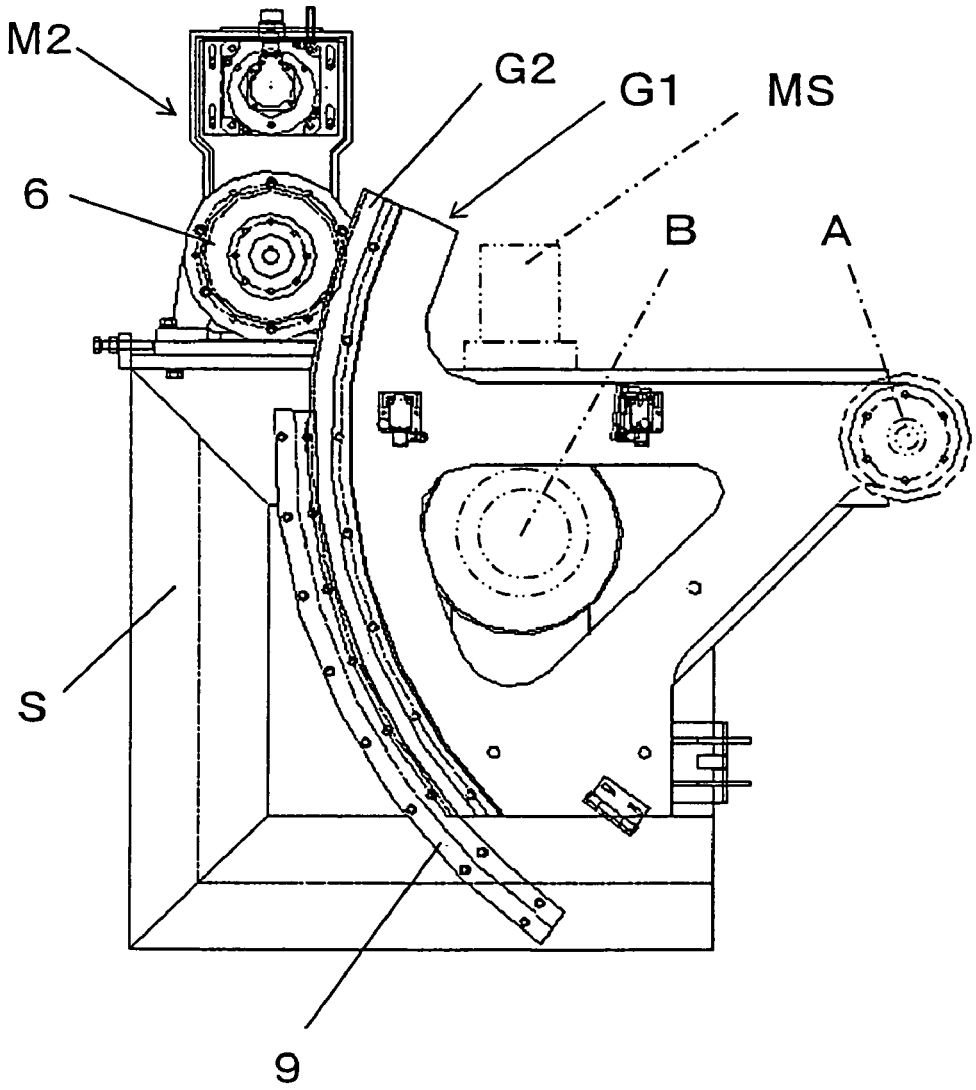
FIG. 3 is a sectional view taken along the line A1-A1 in FIG. 2.
Figure 4:
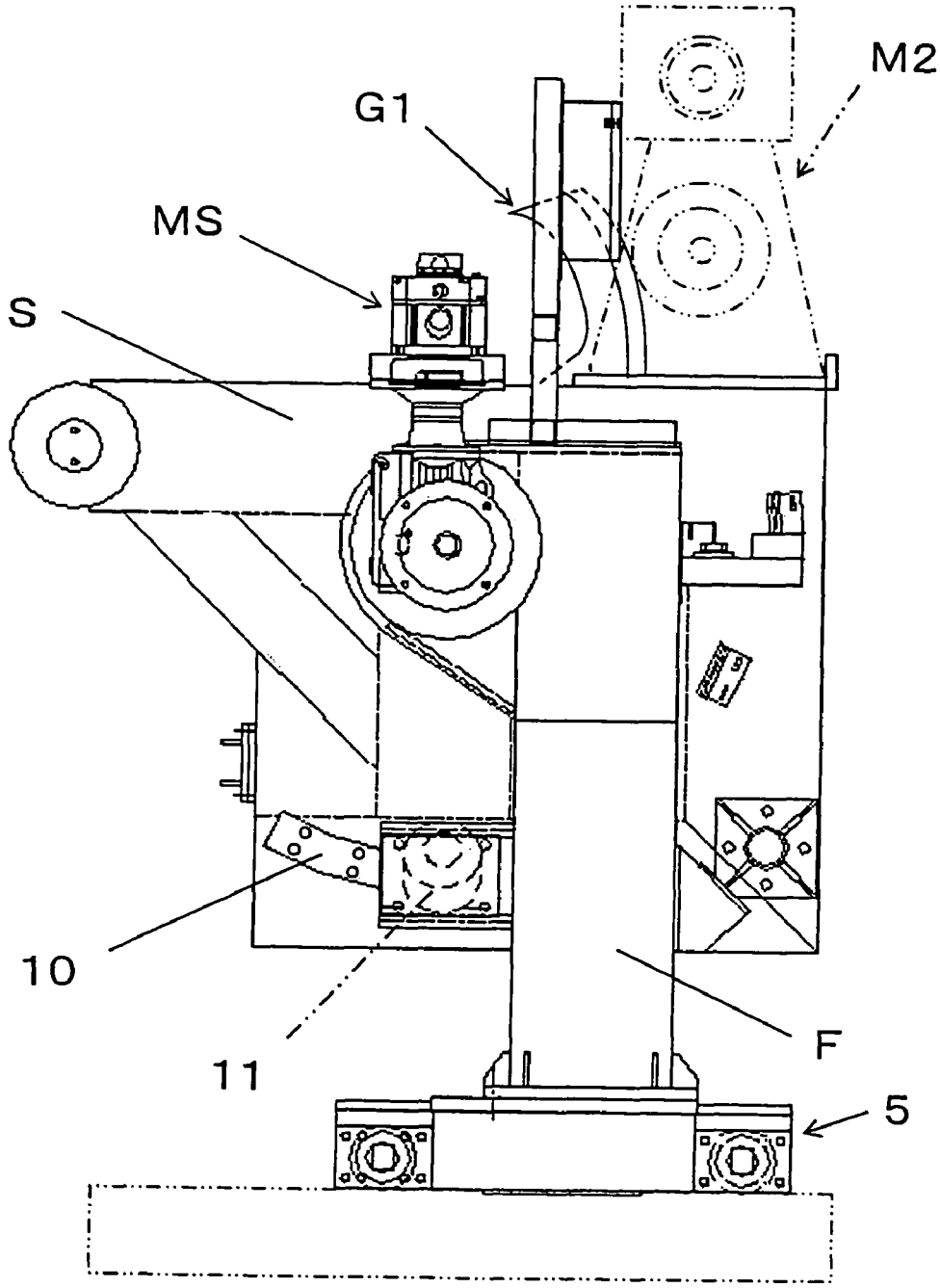
FIG. 4 is a sectional view taken along the line A2-A2 in FIG. 2.

Below the best mode for carrying out the invention is described. The automatic pouring device of the present invention is an automatic pouring device to pour molten metal from a ladle to one or more tight-flask or flaskless molds that travel along a molding line. The automatic pouring device includes a lower cart that travels along the molding line; an upper cart that travels on the lower cart in forward and backward directions that are perpendicular to the molding line, a frame uprightly and fixedly mounted on the upper cart, a first tilting means for tilting the ladle about a first axis of rotation, and an electric control unit provided with a program to control the movement of the ladle in X and Y directions and control the tilt of the ladle about the first axis of rotation.

The pouring method and device of the present invention can be applied to either a tight-flask mold or a flaskless mold.

The wording "at least one pouring device" is used for the pouring method of the present invention, because plural pouring devices may be used according to the molding line.

The wording "a ladle that can pour molten metal in the pouring cup of the mold by tilting" denotes that the present invention is not related to a stopper-type pouring ladle or a pressurized pouring ladle, but related to a ladle that has a center of rotation. The shape of the cross section of the ladle of the invention is, for instance, a sector or a rectangle.

In the present invention, the term "automatic pouring" denotes automatically doing at least some operation that is conventionally manually done by an operator or operators. In the "automatic pouring," the ladle is held, located in position, and tilted; the position in which the molten metal flows out of the ladle and the weight of the poured molten metal are monitored and then controlled by adjusting the position and the tilt angle of the ladle; and the ladle is refilled with molten metal when the molten metal in it is used.

In the pouring method and device of the present invention, the term "the tilt angle about the first axis of rotation" denotes a relative angle with respect to the tilting frame of the ladle 2.

Further, the term "the tilt angle about the second axis of rotation" denotes a relative angle of the tilting frame S with respect to the fixing frame F.

The ladle of the present invention may be exchanged by a transportation means such as a hoist crane, a forklift, or the like. Further, it may be automatically and quickly changed by attaching drive rollers to a ladle-supporting frame and by driving the drive rollers together with other drive rollers attached to a fixed side.

Since the pouring device of the invention has no tall tower, there is nothing to hinder the transfer path of the ladle when it is changed, and thus the transportation means and the transfer path are not limited. This allows the ladle that is to be changed after it has completed the pouring to be promptly exchanged for another ladle, by using a hoist crane, a forklift, or any other transfer means that moves perpendicularly to this ladle.

In the present invention, "a first tilting means for tilting the ladle on the fixed frame about a first axis of rotation" comprises, for example, a sector frame, for supporting the ladle, pivotably mounted on a tilting shaft having the first axis of rotation; a sector gear disposed around the periphery of the sector frame for tilting the sector frame, and a servomotor for driving the sector gear. Through the sector gear the ladle is tilted about the first axis of rotation by the servomotor.

In the present invention, "a second tilting means for further tilting the ladle about a second axis of rotation" comprises, for example, a tilting shaft having a second axis of rotation and passing through a fixed frame, which is in turn uprightly mounted on an upper cart; a servomotor as a drive means, coupled to the tilting shaft; and a tilting frame pivotally mounted on the tilting shaft at the other side, i.e., opposite the side to which the servomotor is coupled. Thus the tilting frame is tilted about the second axis of rotation by the servomotor. Further, the tilting frame is pivotally mounted on the sector frame.

Thus, even if the sector frame does not move, the ladle can be titled by the tilting frame about the second axis of rotation, which differs from the first axis of rotation. When the tilting frame is not moving, the ladle can be tilted by the sector frame about the first axis of rotation.

In the present invention, the means for supporting the ladle is a part mounted on a side surface of the sector frame for supporting the ladle, and the shape of the part differs depending on the shape of the ladle and the method of changing the ladle.

The sector frame is a frame that is pivotably mounted on the tilting shaft having the first axis of rotation, and that directly supports the ladle on it. The sector frame is formed with a sector gear at the circular edge. The center of the sector gear coincides with the first axis of rotation. The sector frame is arranged to be driven to rotate about the first axis of rotation by a drive motor connected to the sector gear.

Below, the automatic pouring method and device of the present invention will be explained in detail by referring to the accompanying drawings.

First Embodiment

FIGS. 1-4 show the first embodiment of the present invention. This embodiment is an example where molten metal is poured from a ladle in molds arranged on a molding line. The embodiment uses an X-axis (extending perpendicularly to the sheet of FIG. 1), a Y-axis (extending in the rightward and leftward directions in the sheet of FIG. 1), a first axis of rotation A (positioned near the tip of the pouring mouth of the ladle in this example), and a second axis of rotation B (in this example positioned near the center of gravity of the ladle).

In FIG. 1, molds 1 are arranged in line with the molding line L and move intermittently. A ladle 2 pours molten metal in these molds 1. An automatic pouring device 3 is used for this pouring.

The automatic pouring device 3 comprises a lower cart 4 movable via wheels 4*b* along a pair of rails 4*a* disposed alongside the molding line L (X-axis), an upper cart 5 movable via front and rear wheels 5*a*, 5*a* on the lower cart 4 in a horizontal direction (Y-axis) perpendicular to the molding line L, a frame F uprightly and fixedly mounted on the upper cart 5, a tilting frame S pivotably supported by this fixed frame F, and a supporting means pivotably supported by the tilting frame S for supporting the ladle 2.

The movement of the lower cart 4 in the forward and backward directions (X-axis), the movement of the upper cart 5 in the lateral (Y-axis) direction, the tilt of the tiling frame S, and the tilt of the ladle 2, are all servo-driven by four respective servomotors, namely, a servomotor M5 for the forward and backward movement, a servomotor M4 for the lateral movement, a tilting servomotor MS for the tilting frame, and a tilting servomotor M2 for the ladle.

Via a sector-shaped sector frame G1 pivotably mounted on a tilting frame S, acting as a support means for the ladle 2; an L-shaped arm 7 disposed at a side surface of the sector frame G1, and a sector gear G2 engaging with a drive gear 6 of the servomotor M2, the ladle 2 is placed on a horizontal part 7*a* of the L-shaped arm 7 and is arranged to be tilted together with the sector frame G1 and the arm 7 about the first axis of rotation A. Further, the arm 7 allows a wheel 8, pivotably mounted on the bottom of the arm, to be tiltably supported by a liner 9 disposed on the side surface of the tilting frame S. This liner 9 is disposed in at least a range within which the sector frame G1 tilts. A liner 10 (FIG. 4) is also disposed on a back surface of the tilting frame S. The liner 10 is disposed in at least a range within which the tilting frame S tilts. The tilting frame S is supported by a wheel 11, which is in turn pivotably supported by the fixed frame F.

The tilting frame S, which is pivotably supported by the fixed frame F, is arranged so that it is tilted by the drive servomotor MS about the second axis of rotation B. Thus the ladle 2 is tilted not only about the first axis of rotation A, but also about the second axis of rotation B, which differs from the first axis of rotation A. Accordingly, by just moving the ladle 2 along the X-axis and Y-axis and tilting it about the axes of rotation A and B when the ladle 2 pours the molten metal, the tilt angles of it about both the first and second axes A and B, and the position of it along the Y-axis (which perpendicularly intersects the molding line L in a horizontal plane), are optimally adjusted.

Figure 5:
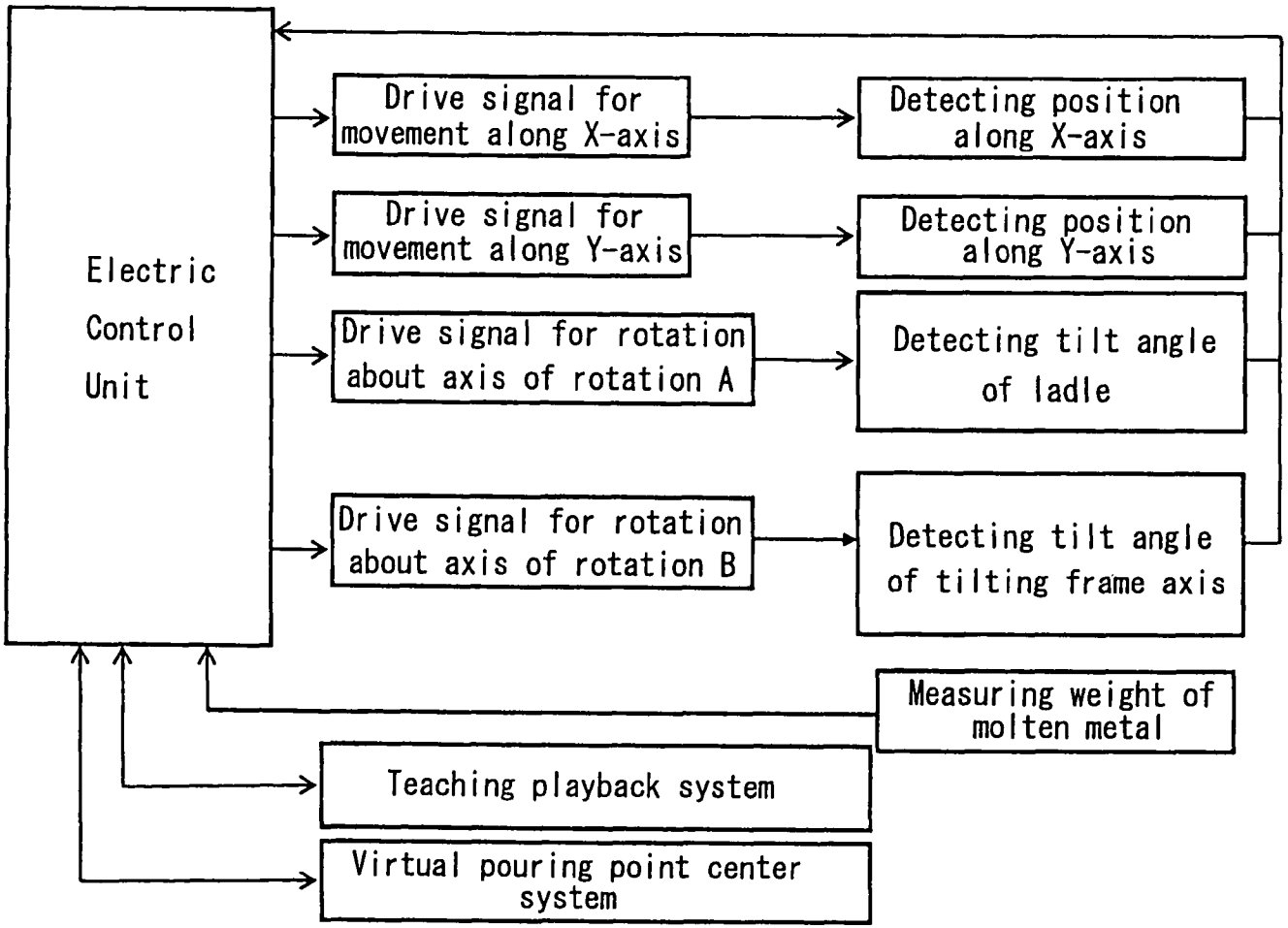
FIG. 5 is an explanatory drawing for the first example of the control in the present invention.

All the servomotors, M4, M5, MS, and M2, are electrically connected with an electric control unit. Below, controlling them is explained by referring to FIG. 5.

The electric control unit includes a program to control the servomotors in relation to the movement of the ladle in the X- and Y-directions and the tilt of it about the first and second axes. This program is called thereby controlling the servomotors so that the ladle pours the molten metal as programmed.

Further, a measuring means, which is a load cell 14, for measuring the weight of the poured molten metal continuously measures the total weight of the upper cart 5 and sends and inputs a signal on the measurements to the electric control unit to calculate the weight of the molten metal remaining in the ladle and the weight of the poured molten metal. The measuring means then judges that the predetermined weight of the molten metal has been poured when the calculated weight of the poured molten metal reaches that predetermined weight. The measuring means then instructs that pouring be stopped by employing a measured-weight feedback system. The weight of the poured molten metal may be alternatively measured by continuously scaling the total weight of the ladle 2 by a load cell, which is a measuring means to control the weight of molten metal to be poured.

Further, as will be explained below, the program may employ a teaching playback system of an optimum pouring program and employ an optimum alignment for the tip of the ladle using the virtual pouring point center system where the axis of rotation of the pouring point is not fixed.

Furthermore, since in the pouring operation the temperature and quality of the molten metal, the tilt angle of the ladle, and the shape, etc., of the ladle, change, during the pouring the flow line of the molten metal changes. Thus a study-and-feedback system may also be applied to carry out the optimum pouring in which these factors of the changes are continuously studied and fed back.

The operation of the automatic pouring device of the present invention will be explained below.

Figure 6:
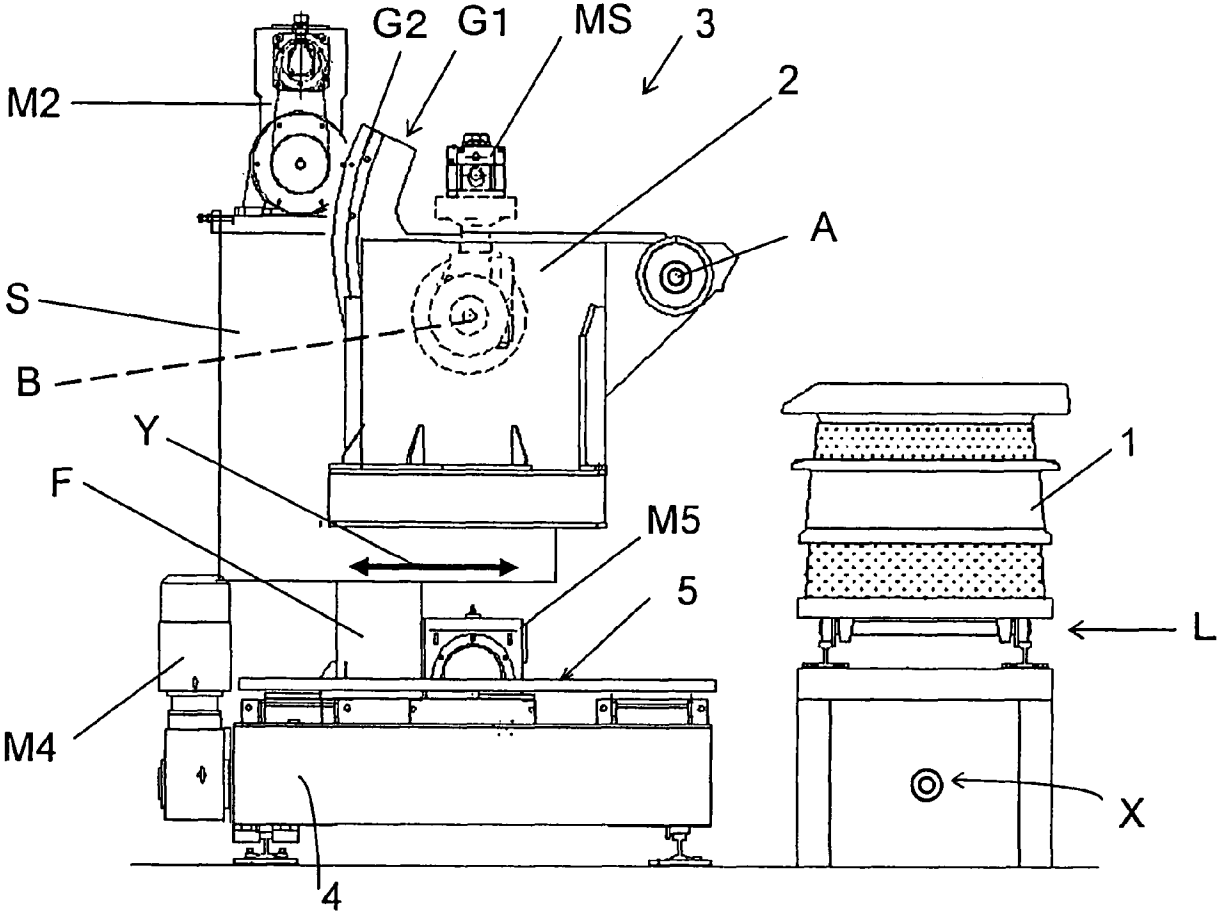
FIG. 6(*a*) is a schematic front view showing the position of the starting point of the operation in the first embodiment of the present invention.
Figure 6:
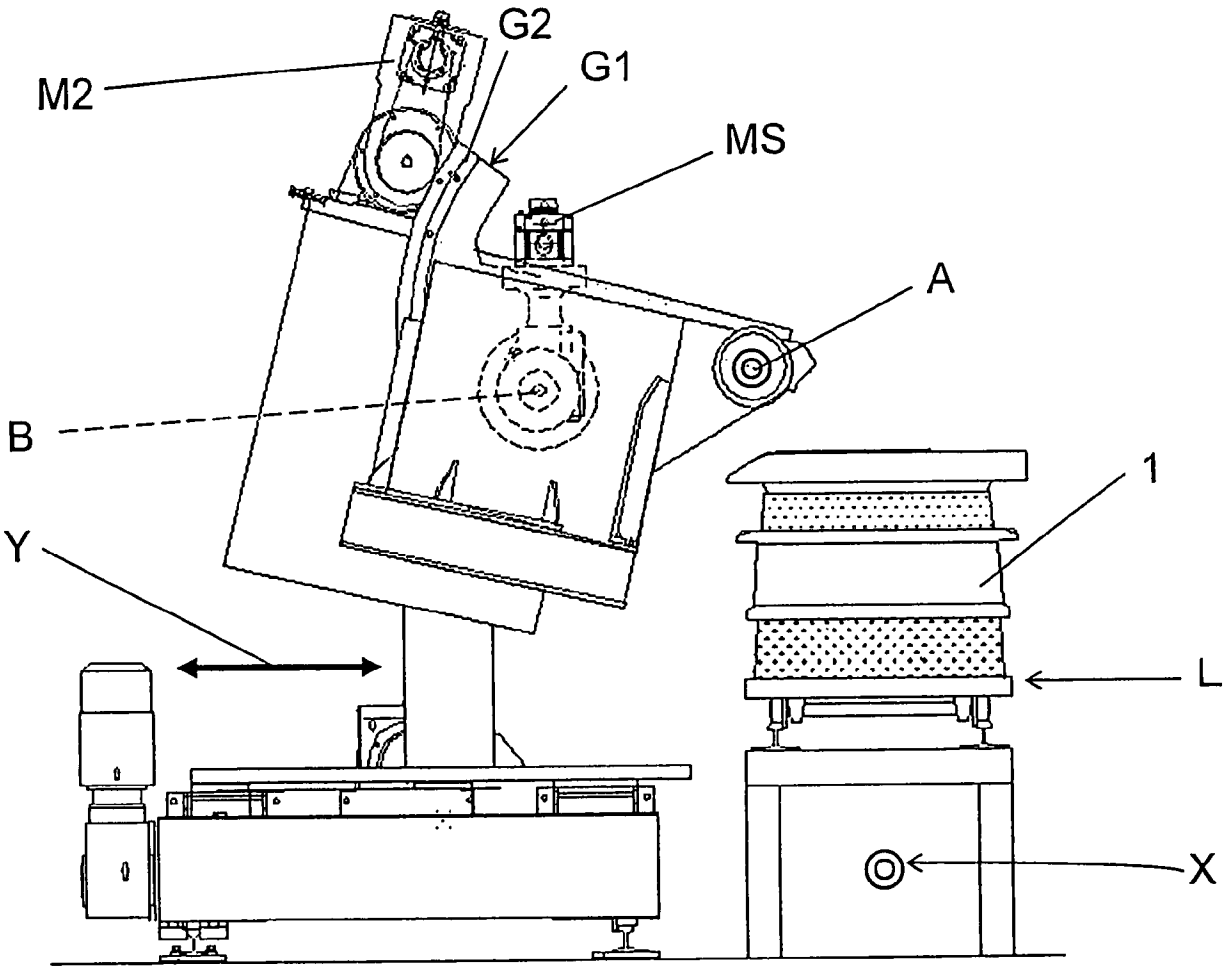
Figure 6:
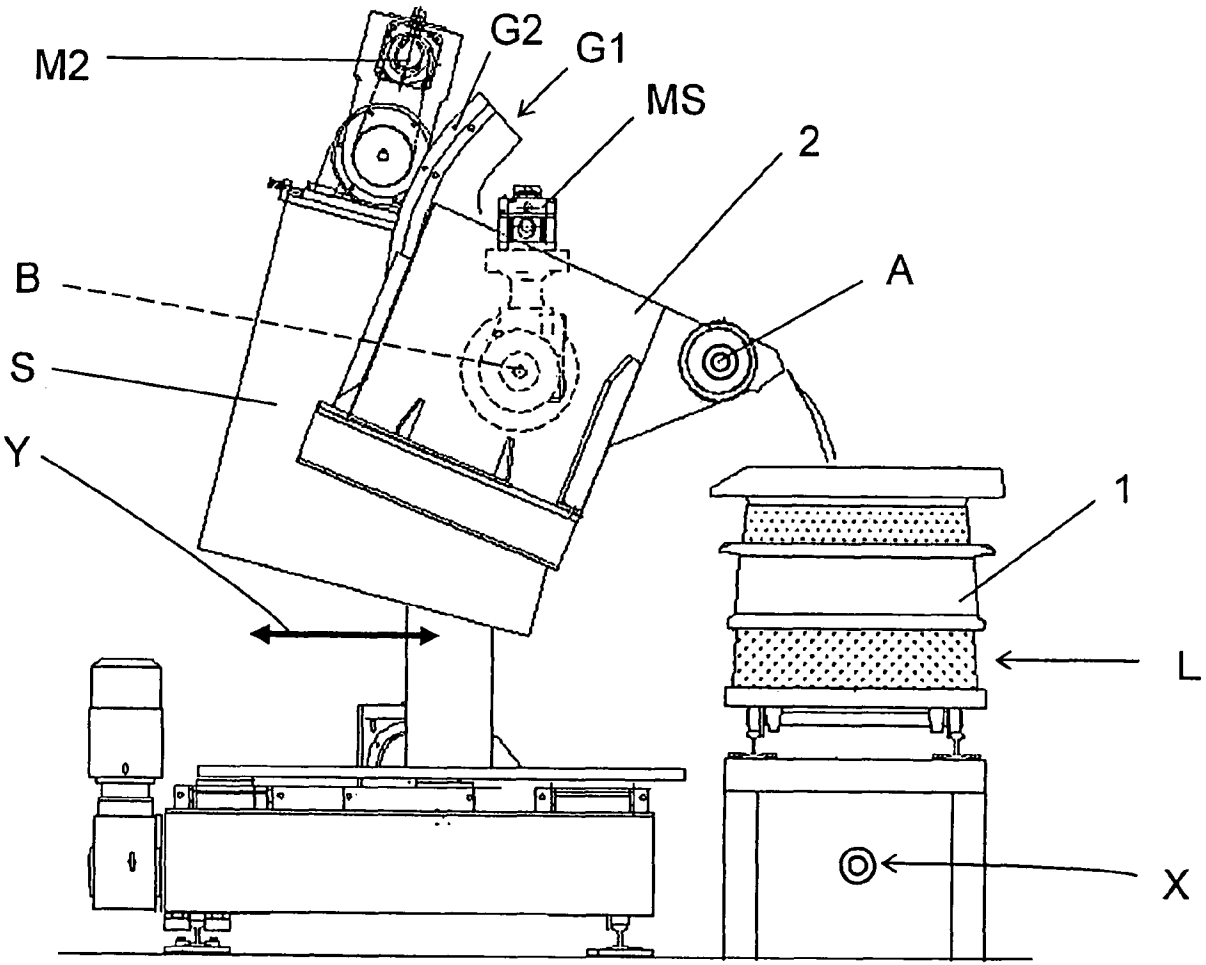
Figure 6:
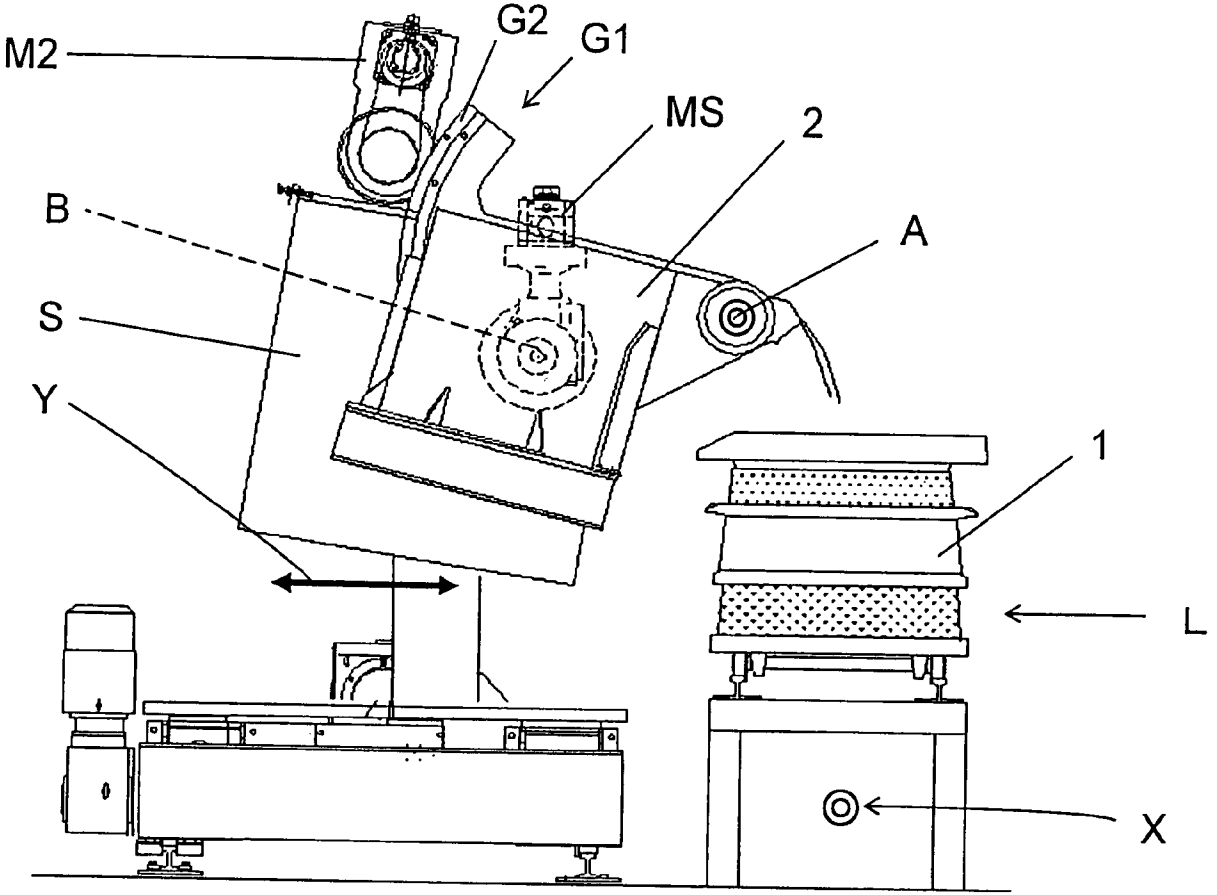
Figure 6:
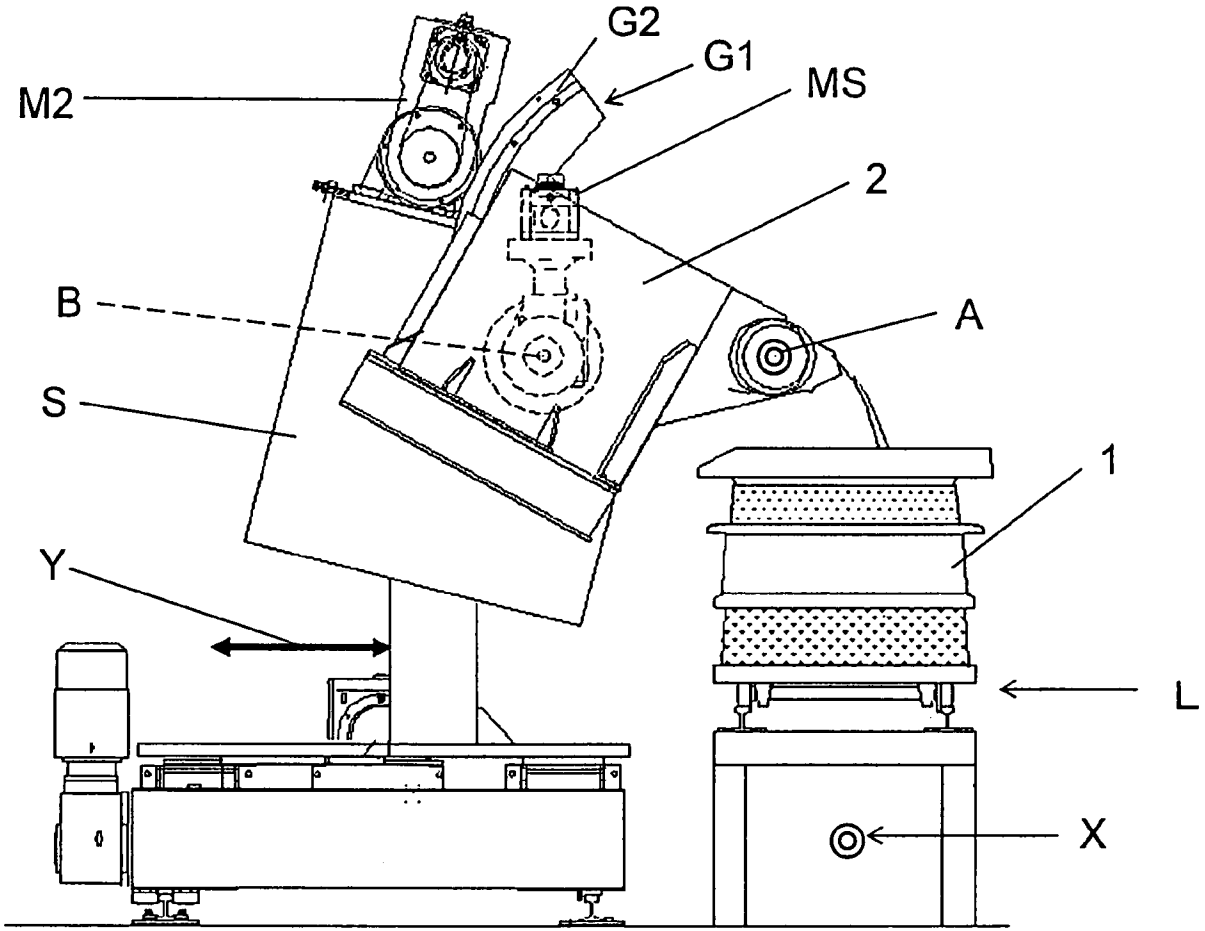
Figure 6:
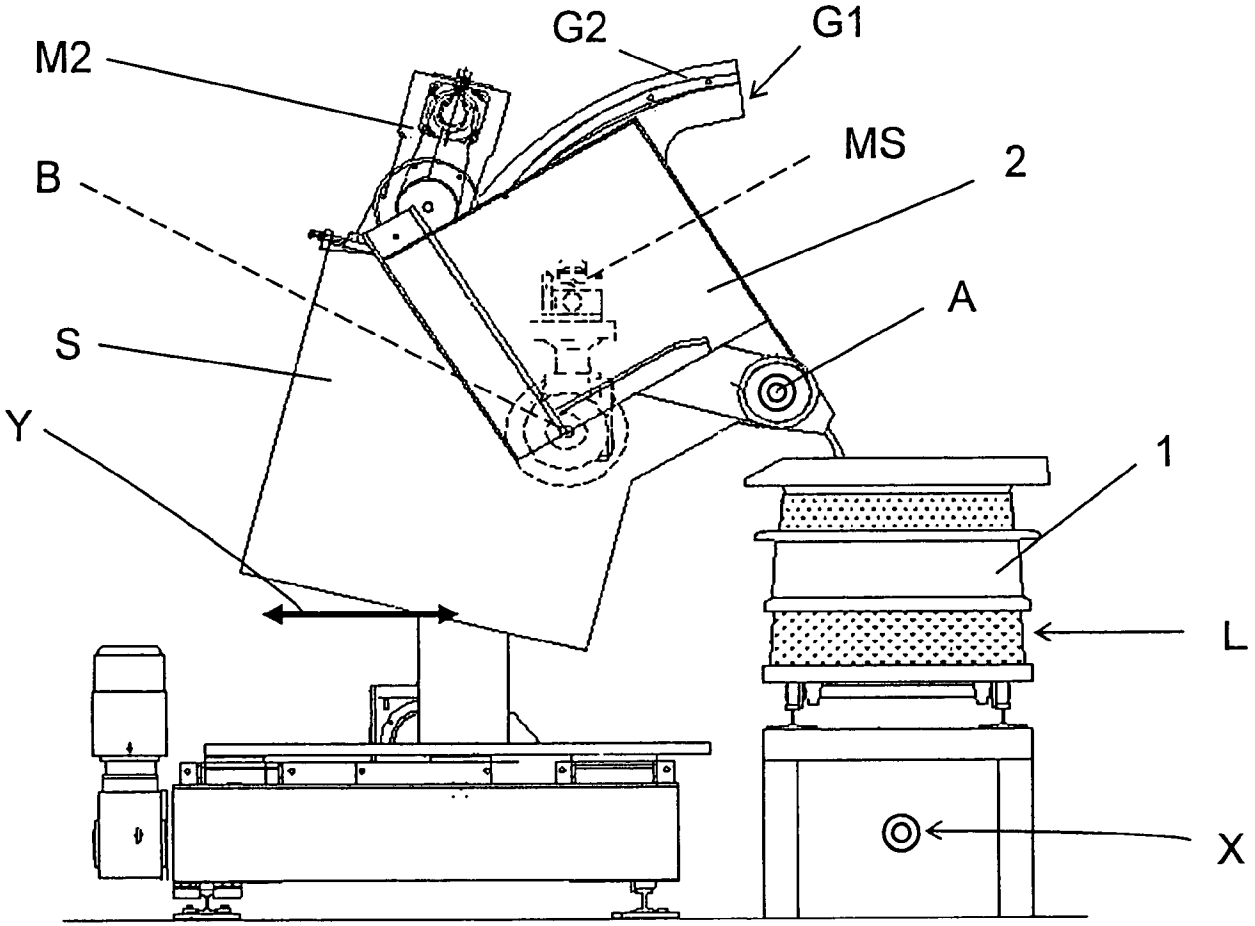

FIG. 6 shows an example of the automatic pouring operation of the automatic pouring device shown in FIGS. 1-4. FIG. 6(*a*) corresponds to FIG. 1 and shows the original position, i.e., the starting position, of the automatic pouring device 3 for the automatic pouring. FIG. 6(*b*) shows the step of pouring preparation. FIG. 6(*c*) shows the step of pouring start. FIG. 6(*d*) shows the step of pouring stop. FIG. 6(*e*) shows the step of restarting pouring after the pouring is once stopped. FIG. 6(*f*) shows the step of tapping all molten metal from the ladle. The step of tapping the molten metal is not always carried out on the mold.

In the starting position in FIG. 6(*a*), the upper cart 5 is positioned in the retraction (back) end of its passage, away from a mold 1. The tilting frame S is kept horizontal (i.e., the tilt angle of it is 0 degree). Accordingly, the bottom of the tilting frame S is now horizontal. Further, the ladle 2 is also kept horizontal (the tilt angle of it is 0 degree). Accordingly, the surface of the molten metal in the ladle 2 is horizontal. Since the lower cart 4 can move alongside the X-axis, the pouring device 3 can move to the places where the molds to be poured with molten metal stand.

In the step of the pouring preparation, shown in FIG. 6(*b*), the pouring is ready to start, with the ladle 2 fully refilled with molten metal. The upper cart 5 moves to the forward distal end of its passage, near the mold 1, to approach it. The tilting frame S is tilted from the horizontal position (where the tilt angle is zero) by, for example, 10 degrees. The ladle 2 is kept horizontal (the tilt angle of it is 0 degree). Thus the relative tilt angle of the ladle to the tilting frame S is zero, and the bottom of the tilting frame S and the bottom of the ladle 2 are parallel. Below the term "tilt angle" is used in this meaning.

FIG. 6(*c*) shows the step of pouring start. The pouring begins. The upper cart 5 approaches the mold 1 and is held at the distal end. The tilt angle of the tilting frame S is kept at ten degrees. At the same time the ladle 2 is tilted from zero to five degrees. This rate of changing the tilt angle is changed by the program.

FIG. 6(*d*) shows the step of pouring stop, i.e., pouring end. The upper cart 5 is held at the distal end near the mold 1. The tilting frame S is tilted back so that its tilt angle is gradually changed from 10 degrees to 5 degrees. During this tilting back the tilt angle of the ladle is kept at 5 degrees. Although for the end of the pouring the measured-weight feedback system (where the amount of the poured molten metal is measured, and then the pouring is finished if the measured amount becomes a predetermined one) is here used, other systems may be used. There are, for example, an optical controlling system, where the surface level of molten metal in a pouring cup is monitored by a camera, a teaching playback system, a study-and-feedback system, etc. Any one of them may be used.

FIG. 6(*e*) shows the step of starting pouring molten metal into another mold after stopping pouring for the previous mold. The upper cart 5 is held at the distal end near the mold 1. The tilting frame S is tilted from a position at 5 degrees to one at 10 degrees. Simultaneously, the ladle is tilted from a position at 5 degrees to one at 10 degrees.

It should be understood that the relative movement of the ladle from one mold 1 to another one is achieved by either moving the lower cart 4 to a next mold to be poured with molten metal or by advancing molds 1 along the molding line L.

FIG. 6(*f*) shows the step of tapping all the molten metal from the ladle 2. The upper cart 5 is held at the distal end near the mold 1. The tilting frame S is held with its tilt angle being at ten degrees. The ladle 2 is held with its tilt angle being more than ten degrees, for example, between 50-70 degrees. By this, all the molten metal is tapped from the ladle 2. However, this step is not always carried out.

Normally, if the amount of molten metal remaining in the ladle is less than the amount necessary for the next pouring after pouring is repeated plural times, the pouring device automatically returns to the starting position, and the ladle is refilled with molten metal. There are various ways to supply molten metal in the ladle. One is to transfer molten metal carried in another ladle (not shown) to the pouring ladle 2 while it is held on the pouring device. Another way is a ladle-removing or ladle-exchanging method, where the ladle 2 is first removed from the automatic pouring device to receive molten metal and then re-mounted on the pouring device after it is refilled with molten metal, or the removed ladle is exchanged with another ladle refilled with molten metal. Any one of these ways may be used.

The relation between the movement along the X-axis and Y-axis, the (relative) tilt angle (of the ladle 2 to the tilting frame) about the first axis of rotation, and the (relative) tilt angle (of the tilting frame S to the fixed frame F), all discussed above, and the pouring steps, also discussed above, are summarized in Table 1 below.

TABLE 1

| | (a) | | (b) | (c) | (d) | (e) | (f) |
|---|---|---|---|---|---|---|---|
| Position | Original position | | Position for preparing pouring | Position for starting pouring | Position for stopping pouring | Position for re-pouring | Position for tapping molten metal |
| What is to be done | Ladle is refilled with molten metal | | Preparing for pouring | Pouring is started | Pouring is stopped | Re-pouring for a next mold | All molten metal remaining in the ladle is tapped |
| X-axis | | Lower cart moves to a position near the mold to be poured with molten metal | | | | Lower cart is positioned relative to a position near the mold to be poured with molten metal | |
| Y-axis | Upper cart is held at the proximal end, spaced apart from the mold | | Upper cart moves to the distal end to approach the mold | Upper cart is held at the distal end near the mold | Upper cart is held at the distal end near the mold | Upper cart is held at the distal end near the mold | Upper cart is held at the distal end near the mold |
| Tilt angle of the tiling frame | 0° | | Changed from 0° to 10° | 10° | Changed from 10° to 5° | Changed from 10° to 5° | 10° |
| Tilt angle of the ladle | 0° | | 0° | Changed from 0° to 5° | 5° | Changed from 5° to 10° | 50°--70° |

Thus, in this embodiment, adjusting the movement along the X-axis and Y-axis, the tilt angle about the first axis of rotation, and the tilt angle about the second axis of rotation, allows the ladle 2 to pour with its poring point being located in a lower position.

This embodiment is one example of the pouring steps. It also may be possible to execute some steps at the same time as long as the operations of the steps do not interfere with each other. Some steps that could be simultaneously executed may be sequentially executed.

Further, the adjustment may be made by the teaching playback system, etc., according to the flow line of the molten metal, which changes depending on the nature of the molten metal, the shape of the ladle, etc. Since the program can be promptly switched, this pouring can be applied for low volume production of a wide variety of products. In these cases the control of the movement along the X-axis and Y-axis and the tilt of the ladle are servo-driven at the same time, when necessary, at least from the starting to stopping of the pouring.

Below a teaching playback system and the virtual pouring point center system, each of which is an effective system when used from the starting to the stopping of the pouring, is now described in detail.

In this embodiment, the teaching playback system may be used to utilize the skill of the expert worker. By the teaching playback system, the expert worker sets the way of pouring only the first time, and the next pouring is repeated by using a teaching playback program, which learned the teaching of the best pouring program. Namely, when the movement along the X-axis and Y-axis and the tilt of the ladle 2 are controlled at least from the starting to the stopping of pouring, only the first time does the expert operator pour the molten metal from the ladle to the mold. The relation between the position in the Y direction, the tilt angles about the axes of rotation, the pouring rate, and the time for this operation, are stored in the electric control unit as a program. Similarly, further programs are also stored in it when the products to be cast change. One of the programs that is determined, prior to casting, to match a given product to be cast, is selected in view of the pattern number, the flask number, the product number, etc. The selected program is called and used for pouring. Further, the teaching playback system can be started when the pouring starts. This starting of the pouring may be detected by an optical means by detecting the occurrence of the molten metal being tapped from the ladle, and it is then fed back so that a pouring program selected or changed for the best pouring for a given product is carried out.

Further, the teaching playback system can be terminated when the pouring ends. When the measured weight of the poured molten metal reaches the predetermined amount, the end of the pouring may be fed back as the point of completion of the running pouring program, which has been changed for the given product to be cast.

Below the embodiment that uses the virtual pouring point center system will be explained in detail. In this system, while the ladle is being tilted about the first axis of rotation, the second axis of rotation is moved along a circular locus about the point of the pouring mouth of the ladle at which the molten metal starts to fall or about a virtual pouring point that is determined as a point near that point of the pouring mouth. Namely, during the pouring the ladle is controlled to move about the first axis of rotation A, about the second axis of rotation B, and along the Y-axis, so that the ladle itself rotates about the first axis of rotation A, and so that the second axis of rotation B moves along the circular locus about the point of the pouring mouth of the ladle at which the molten metal starts to fall or about the virtual pouring point so determined. By this control for the movement, the relation between the position of the pouring cup of the mold 1 and the position of the point of the pouring mouth of the ladle at which the molten metal stars to fall is substantially maintained constant.

In this embodiment, the ladle 2, which is placed on the horizontal part 7*a* of the arm 7, is arranged to be tilted about the first axis of rotation A by the servomotor M2 together with the sector frame G1 and the arm 7. Further, the tilting frame S, which is pivotably mounted on the fixed frame F, is arranged to be tilted about the second axis of rotation B by the drive servomotor MS.

The tilt angles of the first axis of rotation A and the second axis of rotation B may be detected by suitable angle detection means (not shown), such as encoders.

Further, the relation between the position of ladle 2 along the Y-axis, the tilt angles of the axes of rotation, the pouring rate, and the time, is stored as a program in the electric control unit. The tilt angles of the ladle 2 are detected by the angle detection means, or the weight of the poured molten metal is measured by the measuring means for measuring the weight of the poured molten metal, and according to the variations of these factors the tilting rates of the ladle, etc., are then controlled by the electric control unit.

When the pouring starts, it is checked by a position-detection means (not shown) at the moment where the ladle 2 starts to rotate, if the position of the pouring cup of the mold 1 and the pouring point of the ladle at which the molten metal starts to fall are kept in the predetermined relation. If so, pouring the molten metal will be started. Further, according to the tilt angle of the ladle 2, the electric control unit then sends drive signals to the servomotor MS for tilting the tilting frame and to the servomotor M2 for tilting the ladle, so that the predetermined tilting rates are obtained.

After the predetermined weight of the molten metal is poured in the mold, the ladle is then tilted back about the second axis of rotation B.

Since thus the virtual pouring point center system can be quickly prepared for the varying weight of the molten metal to be poured even if a ladle has a varying molten metal surface area according to its tilt angle, it can use any existing ladles that have a cross section other than a sector. Further, also if the pouring mouth of the ladle 2 and the pouring cup of the mold 1 are extremely close to each other, the predetermined relation between the position of the point of the pouring mouth of the ladle at which the molten metal starts to fall and the position of the pouring cup of the mold is maintained, and the flow line of the poured molten metal between the ladle and the pouring cup of the mold hence is kept within a constant range, providing good pouring.

Second Embodiment

In the first embodiment the tilt of the two axes of rotation (axes of rotation A and B) is used. However, if the pouring is not intended for low volume production of a wide variety of products, but intended for producing, for example, a large volume of the same products, the tilt of only one axis of rotation may be used. Further, this is especially suitable to the molding line in the vertical-type flaskless-mold molding machine, since the height of that molding machine is always constant.

If the tilt of only one axis of rotation is used, the initial height of the pouring point of ladle 2 at the starting point (the original position) should be adjusted to be at an appropriate level higher than the upper surface of the mold 1. Further, when in the original position, the first axis of rotation of the ladle 2 is in a position closer to the molding line L than is the fixed frame F.

When the virtual pouring point center system is used in embodiment 2, the pouring point of the ladle is positioned at an optimum level relative to the level of the pouring cup of the mold (wherein the ladle will be rotated at a point near its center of gravity about the pouring point), and the lateral position of the ladle is also optimally adjusted relative to the lateral position of the pouring cup by the lateral travel of the upper cart.

Figure 7:
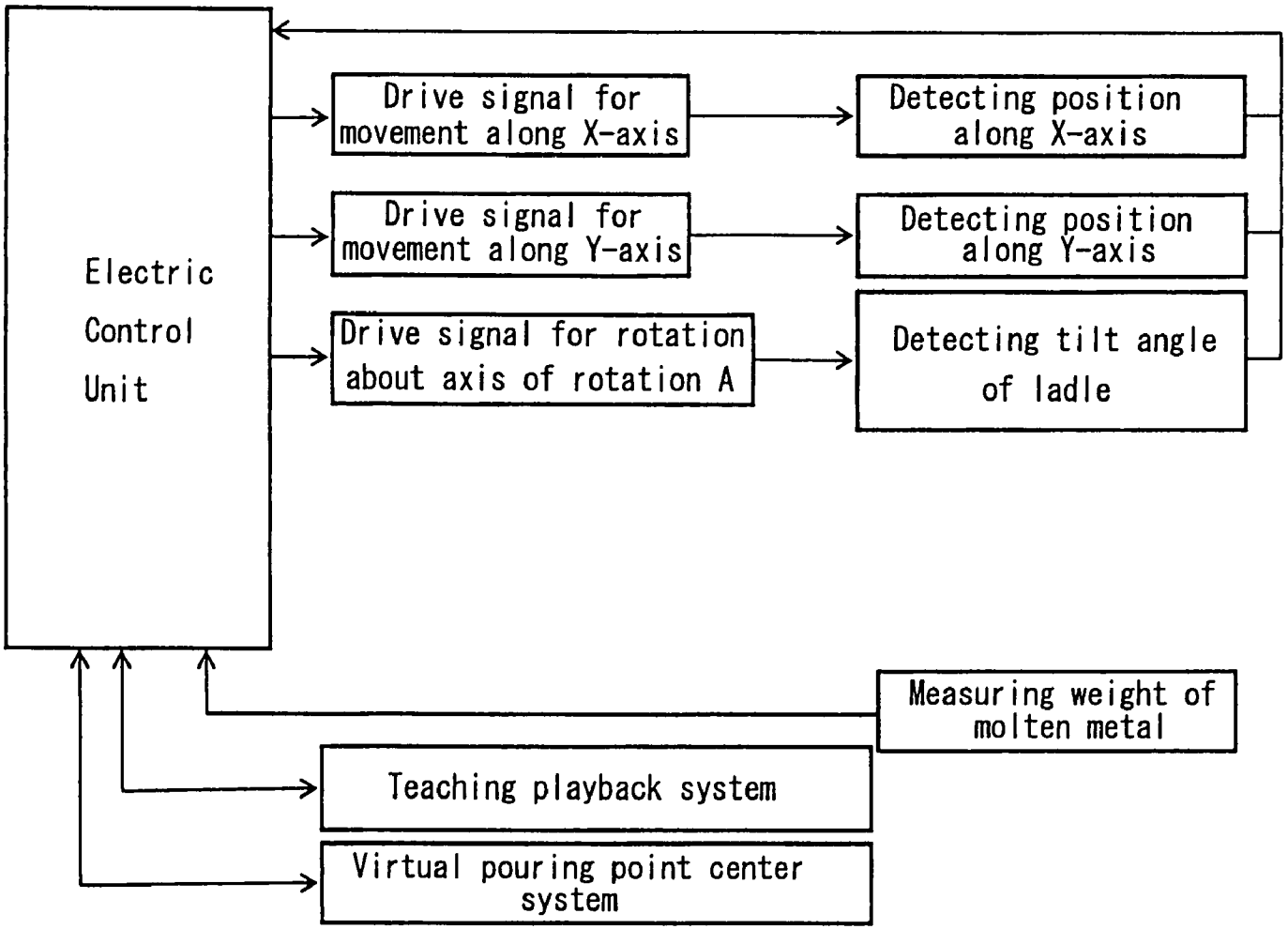
FIG. 7 is an explanatory drawing for the second example of the control in the present invention.

Further, FIG. 7 is a block diagram to show the control system in the second embodiment. Table 2 shows the procedure in the second embodiment of the present invention.

TABLE 2

| | (a) | | (b) | (c) | (d) | (e) | (f) |
|---|---|---|---|---|---|---|---|
| Position | Original position | | Position for preparing pouring | Position for starting pouring | Position for stopping pouring | Position for re-pouring | Position for tapping molten metal |
| What is to be done | Ladle is refilled with molten metal | | Preparing for pouring | Pouring is started | Pouring is stopped | Re-pouring for a next mold | All molten metal remaining in the ladle is tapped |
| X-axis | | Lower cart moves to a position near the mold to be poured with molten metal | | | | Lower cart is positioned relative to a position near the mold to be poured with molten metal | |
| Y-axis | Upper cart is held at the proximal end, spaced apart from the mold | | Upper cart moves to the distal end to approach the mold | Upper cart is held at the distal end near the mold | Upper cart is held at the distal end near the mold | Upper cart is held at the distal end near the mold | Upper cart is held at the distal end near the mold |
| Tilt angle of the ladle | 0° | | 0° | Changed from 0° to 5° | 5° | Changed from 5° to 10° | 50°--70° |

Also in the second embodiment, either the teaching playback system or the virtual pouring point center system, or both of them, are used. In any case the existing ladles can be used only by changing the program. Especially, during the steps from the starting to stopping of the pouring, using the teaching playback system and the virtual pouring point center system enables the pouring to be executed by an extremely simple shaft arrangement.

Further, though the support means for the ladle is tilted by drive means through the sector gear, it is also possible to tilt the support means through a chain and other transmission means.

Further, the ladle can be exchanged by a ladle carrier device (not shown) such as a hoist crane, a forklift, etc. Further, the change can be carried out by providing and using drive rollers.

From the foregoing explanation, clearly the present invention can establish pouring at a lower level by adjusting the relation between the movement along the X-axis and the Y-axis and the tilt angle of the first axis of rotation.

Especially, in this embodiment, the automatic pouring device will be more compact and at a lower price and can give a remarkable energy-saving effect, since only three servomotors, for the driving relating to the X-axis, the Y-axis, and the tilting, are used.

Figure 8:
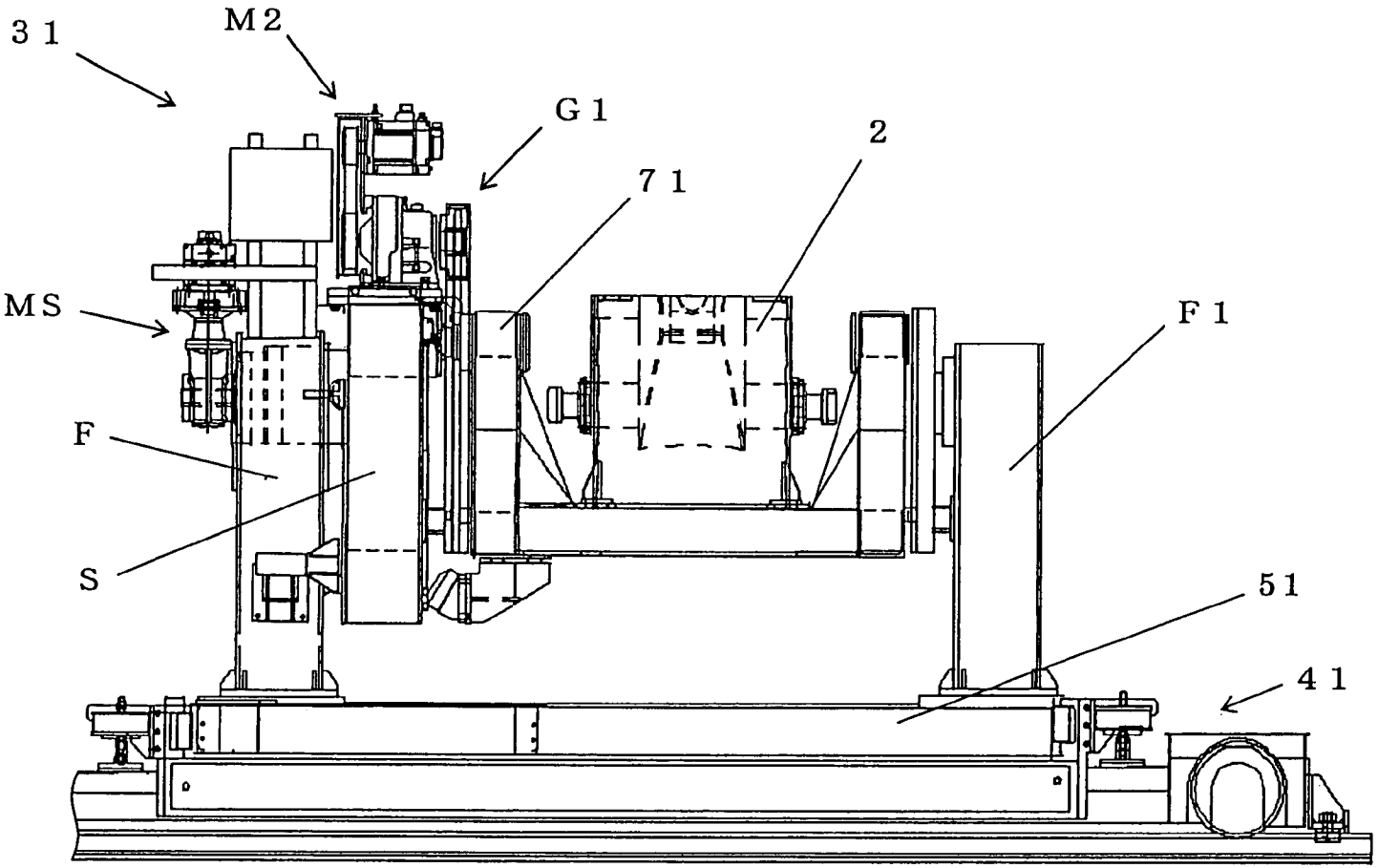
FIG. 8 is a side view of another embodiment of the automatic pouring device of the present invention.

In both the first and second embodiments of the pouring devices 3, the ladle 2 is put on the L-shaped arm 7, which is one of the elements of the support means pivotably mounted on the tilting frame, which in turn is pivotably mounted on the fixed frame F. Specifically, in the embodiments the ladle 2 is put on the cantilever-type, L-shaped arm 7. However, the present invention is not limited to this arrangement. For example, like the pouring device 31 shown in FIG. 8, in place of the L-shaped arm 7, a U-shaped arm 71 may be tiltably mounted on a pair of fixed frames F, F1, which are upwardly mounted on the upper cart 51. Thus the ladle 2 is placed on the U-shaped arm 71, which is what is called a simple beam. Since this arrangement stably holds the ladle 2, the capacity of the ladle 2 can be enlarged. In FIG. 8, the reference number 41 denotes the lower cart. The same reference numbers are used for the same elements as in the above embodiment.

Figure 9:
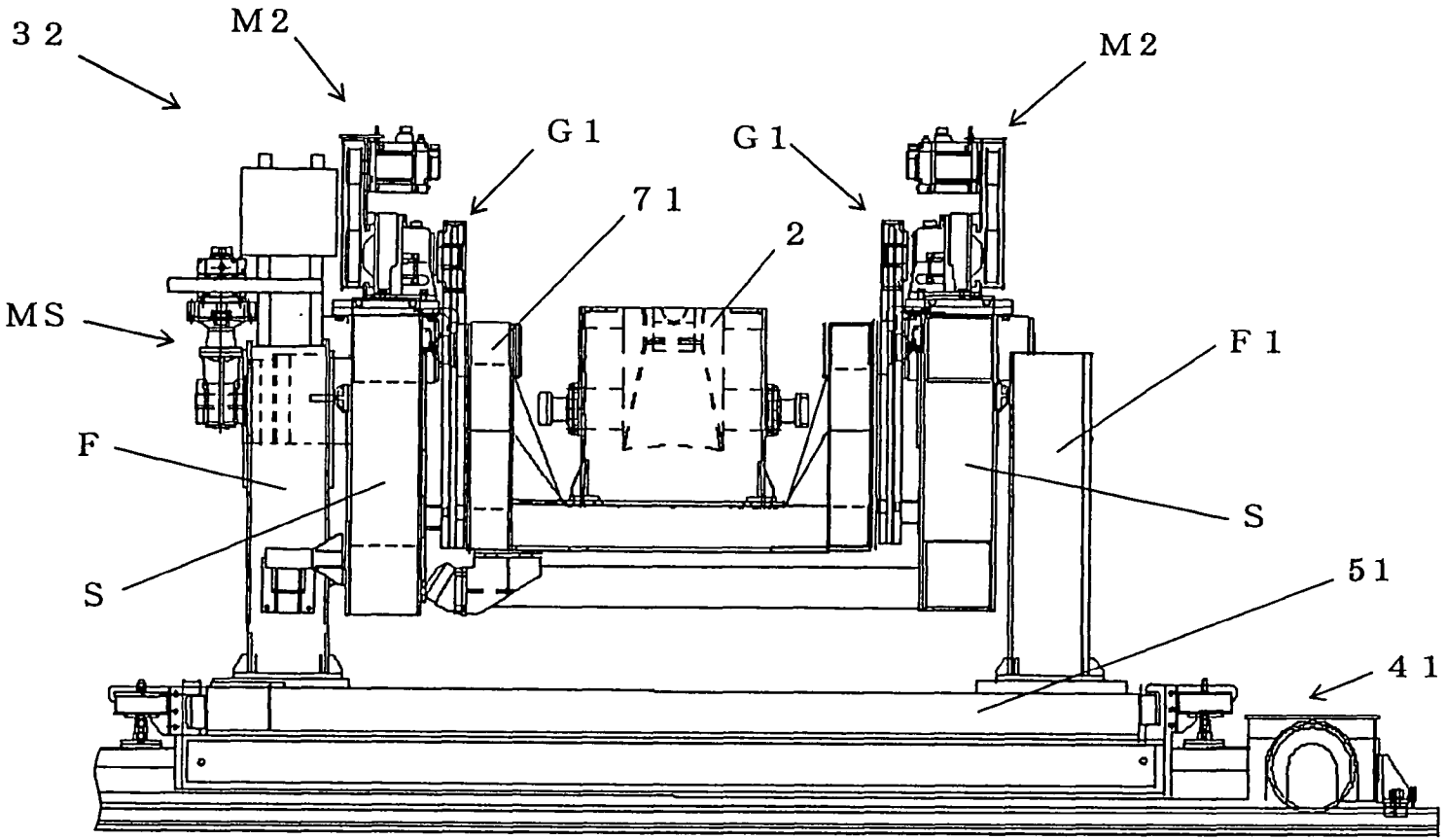
FIG. 9 is a side view of a further embodiment of the automatic pouring device of the present invention.

Further, as shown in FIG. 9, the sector frame G1 and the servomotor M2, which are the components of the support means, and the tilting frame S, may also be assembled to the fixed frame F1. In the pouring device 32 shown in FIG. 9 the ladle 2 may be smoothly tilted by synchronously driving the pair of servomotors M2.

The invention claimed is:

1. An automatic pouring device for pouring molten metal from a tiltable ladle into at least one mold in a molding line, comprising:

a lower cart movable along an X-axis parallel to the molding line;

an upper cart mounted on the lower cart for lateral movement of the upper cart along a Y-axis perpendicular to the molding line and in a horizontal plane;

a fixed frame fixedly mounted on the upper cart;

a tilting frame pivotally mounted on the fixed frame about an axis of rotation;

a first tilting means for tilting the ladle about a first axis of rotation on the fixed tilting frame;

a second tilting means for tilting the ladle about a second axis of rotation on the fixed frame that differs from the first axis of rotation, and that is located at a position closer to a center of the ladle than is the first axis of rotation, wherein the second tilting means includes the tilting frame and the second axis of rotation is the axis of rotation of the tilting frame; and an electric control unit having a program for controlling and adjusting the tilt angle of the ladle about the first axis of rotation, and the tilt angle of the ladle about the second axis of rotation without vertically moving the ladle when the molten metal is to be poured.

2. The automatic pouring device of claim 1, wherein the electric control unit is further provided with a program that tilts the ladle about the first axis of rotation at least for a period from the starting of the pouring to just before the stopping of the pouring and tilts the ladle about the second axis of rotation back when the pouring is to be stopped.

3. The automatic pouring device of claim 2, wherein the electric control unit is further provided with a program for simultaneously controlling the tilt and the movement of the ladle along the X-axis and Y-axis at least for a period from the starting of the pouring to the stopping of the pouring.

4. The automatic pouring device of claim 1 or 2, wherein the electric control unit is provided with a teaching playback program that can run for a selected product to be cast.

5. The automatic pouring device of claim 1 or 2, further including a load cell coupled to the electric control unit for measuring a weight of the poured molten metal.

6. The automatic pouring device of claim 1 or 2, wherein a moving device for moving the mold in the molding line is provided with a sensor for detecting the traveling rate of the mold, and wherein a drive device for the lower cart includes a servomotor or an inverter-controllable drive motor for driving the lower cart along the X-axis at the detected traveling rate of the mold.

7. The automatic pouring device of claim 1 or 2, wherein the first tilting means comprises a sector frame supporting the ladle, a sector gear disposed around a periphery of the sector frame and a servomotor for driving the sector gear, the servometer being mounted on the tilting frame.

* * * * *